US012774641B2

(12) United States Patent
Menger et al.

(10) Patent No.: US 12,774,641 B2
(45) Date of Patent: Oct. 27, 2026

(54) PRESSURE WAVE-BASED STEERING AND COMMUNICATION SYSTEMS

(71) Applicant: D-TECH UK LTD., Filton (GB)

(72) Inventors: Christian Menger, Houston, TX (US); Peter Hornblower, Houston, TX (US)

(73) Assignee: D-TECH UK LTD., Filton (GB)

( * ) Notice: Subject to any disclaimer, the term of this patent is extended or adjusted under 35 U.S.C. 154(b) by 134 days.

(21) Appl. No.: 18/252,745

(22) PCT Filed: Nov. 12, 2021

(86) PCT No.: PCT/IB2021/060517
§ 371 (c)(1),
(2) Date: May 12, 2023

(87) PCT Pub. No.: WO2022/101849
PCT Pub. Date: May 19, 2022

(65) Prior Publication Data

US 2024/0003199 A1 Jan. 4, 2024

Related U.S. Application Data

(60) Provisional application No. 63/113,041, filed on Nov. 12, 2020.

(51) Int. Cl.
*E21B 17/10* (2006.01)
*E21B 4/02* (2006.01)
(Continued)

(52) U.S. Cl.
CPC ..... *E21B 17/1014* (2013.01); *E21B 4/02* (2013.01); *E21B 7/06* (2013.01); *E21B 47/18* (2013.01)

(58) Field of Classification Search
CPC ..... E21B 7/06; E21B 7/068; E21B 47/18
See application file for complete search history.

(56) References Cited

U.S. PATENT DOCUMENTS 6,089,332 A * 7/2000 Barr ..... E21B 21/10 175/45
8,708,064 B2 * 4/2014 Downton ..... E21B 7/062 175/45

(Continued)

FOREIGN PATENT DOCUMENTS

WO WO 2019/133003 7/2019

OTHER PUBLICATIONS

International Search Report and Written Opinion issued in Corresponding PCT Application No. PCT/IB2021/060517, dated Feb. 28, 2022.

*Primary Examiner* — Tara Schimpf
*Assistant Examiner* — Ursula Lee Norris
(74) *Attorney, Agent, or Firm* — Norton Rose Fulbright US LLP

(57) ABSTRACT

A bottom hole assembly (BHA) is disclosed. The BHA comprises a directional control system configured to control a position of the BHA relative to a borehole, the directional control system comprising: a device body defining an inlet and a plurality of ports; at least one device sensor configured to detect a first downhole parameter a plurality of deflection actuators coupled to the device body and each in fluid communication with a corresponding one of the ports, each of the plurality of deflection actuators configured to be selectively actuated to steer the BHA; a controller configured to receive data from the at least one device sensor; and a valve body configured to selectively permit fluid communication between the inlet and one or more of the plurality of ports to actuate the respective deflection actuators; wherein the controller is configured to actuate the valve body to adjust fluid communication to the one or more of the plurality of ports to: steer the BHA; and communicate data indicative of the detected first downhole parameter.

20 Claims, 4 Drawing Sheets

(51) Int. Cl.
*E21B 7/06* (2006.01)
*E21B 47/18* (2012.01)

(56) References Cited

U.S. PATENT DOCUMENTS

| | | | | |
|---|---|---|---|---|
| 8,763,725 | B2 | 7/2014 | Downton | |
| 9,035,788 | B2 * | 5/2015 | Downton | E21B 47/20 340/853.3 |
| 10,605,005 | B2 * | 3/2020 | Downton | E21B 47/024 |
| 11,118,403 | B1 * | 9/2021 | Feddema | E21B 21/10 |
| 12,084,969 | B2 * | 9/2024 | Hay | E21B 41/0085 |
| 2014/0014413 | A1 | 1/2014 | Niina et al. | |
| 2017/0198525 | A1 | 7/2017 | Feddema et al. | |
| 2020/0392839 | A1 * | 12/2020 | Dwars | E21B 21/12 |

* cited by examiner

PRESSURE WAVE-BASED STEERING AND COMMUNICATION SYSTEMS

CROSS-REFERENCE TO RELATED APPLICATIONS

This application is a national phase under 35 U.S.C. § 371 of International Application No. PCT/IB2021/060517, filed Nov. 12, 2021, which claims the benefit of priority to U.S. Provisional Patent Application Ser. No. 63/113,041, filed Nov. 12, 2020, the entire contents of each of which are hereby incorporated by reference in their entirety.

FIELD OF INVENTION

The present invention relates generally to steering and communication systems, and, more particularly, to pressure wave-based steering and communication systems for use in subterranean wells (e.g., while drilling such wells).

FIELD OF INVENTION

Hydrocarbon (e.g., oil and gas) recovery typically involves drilling a subterranean well. Such wells may extend thousands of feet below the surface, and may deviates from a vertical axis. For example, developments in directional drilling over recent decades have enabled the drilling of wells that extend laterally.

Rotary steerable drilling systems are frequently used in drilling applications to allow accurate wellbore placement along a predetermined path. Such rotary steerable drilling systems include a drill string with at least drill pipe and a bottom hole assembly (BHA) that includes a drill bit, a directional control tool connected to the drill bit and configured to control the direction of drilling, and/or mud motors to increase drill bit rotary speed without increasing the rotary speed of the drill string (which is controlled at the surface). The BHA may also include a data acquisition system or "sub" with a surface telemetry system, measurement-while-drilling (MWD) system, and/or logging-while-drilling (LWD) system. The data acquisition system/sub (DAS) may be spaced along the drill string a distance away from (e.g., above or up-hole from) the directional control tool and/or the drill bit.

Various types of sensors within the MWD system and LWD system may be used to measure direction (e.g., inclination and azimuth) of portions of the wellbore through which the DAS travels, formation properties (e.g., gamma ray, resistivity, and/or the like) of portions of the wellbore through which the DAS travels, drill string component shock and vibration levels, and absolute and differential pressure values inside the drill string and in an annulus between the drill string and the formation. Some of the data acquired downhole by the DAS during drilling operations may be sent to the surface (i.e., computers or other equipment at the surface) via a surface telemetry system, either in real-time or at predetermined time intervals.

In addition to those of LWD and MWD, the BHA may include additional sensors that capture data (e.g., direction) used by the directional control tool for steering. In instances where the DAS is spaced apart from the directional control tool, that additional data has typically not been transmitted to the DAS. Where communication is desired between the directional control tool and the DAS or one of its components (e.g., MWD system, LWD system, telemetry system, and/or etc.)—such as to relay a message from a surface telemetry system to the directional control tool or to relay sensor data from the directional control tool to the MWD, LWD, and/or surface telemetry system—a hardwired connection between drill string components has been required. However, it can be highly difficult and/or prohibitively expensive to make such hardwired connections functional and/or durable enough to function in downhole environments, which can subject drill string components to high temperatures, high pressures, and repetitive stresses and wear. In some instances, these challenges are complicated by the fact that the directional control system may rotate with the drill bit relative to the DAS.

For these and other reasons, a need exists for simplified and reliable communication between the directional control tool and the LWD, MWD, and/or surface telemetry system.

SUMMARY

Some embodiments of the present bottom hole assemblies (BHAs) comprise a directional control system configured to control a position of the BHA relative to a borehole, the directional control system comprising: a device body defining an inlet and a plurality of ports; at least one device sensor configured to detect a first downhole parameter; a plurality of deflection actuators coupled to the device body and each in fluid communication with a corresponding one of the ports, each of the plurality of deflection actuators configured to be selectively actuated to steer the BHA; a controller configured to receive data from the at least one device sensor; and a valve body configured to selectively permit fluid communication between the inlet and one or more of the plurality of ports to actuate the respective deflection actuators; wherein the controller is configured to actuate the valve body to adjust fluid communication to the one or more of the plurality of ports to: steer the BHA; and communicate data indicative of the detected first downhole parameter.

In some embodiments of the present BHAs, the valve body is actuated by the controller to simultaneously steer the BHA and communicate data indicative of the detected downhole parameter.

In some embodiments of the present BHAs, the controller is configured to: steer the BHA in response to a first value of the first downhole parameter being detected by the at least one device sensor; and communicate data in response to a second value of the first downhole parameter being detected by the at least one device sensor.

In some embodiments of the present BHAs, the first downhole parameter is fluid pressure, flow rate, or acoustics. In some embodiments of the present BHAs, the first downhole parameter is continuously detected by the at least one device sensor. In some embodiments of the present BHAs, the first downhole parameter is detected at predetermined intervals of time.

In some embodiments of the present BHAs, to steer the BHA, the controller is configured to actuate the valve body such that a first volume of fluid is directed to the one or more of the plurality of ports to actuate the respective deflection actuator; and to communicate data indicative of the detected first downhole parameter, the controller is configured to actuate the valve body such that a second volume of fluid is directed to the one or more plurality of ports to actuate the respective deflection actuator.

In some embodiments of the present BHAs, the first volume of fluid is greater than the second volume of fluid. In some embodiments of the present BHAs, the second volume of fluid is less than the first volume of fluid.

Some embodiments of the present BHAs comprise a rotary drill bit configured to be coupled to the device body.

In some embodiments of the present BHAs, the device body is configured to be rotated with the rotary drill bit. In some embodiments of the present BHAs, each of the plurality of ports are configured to be rotated with the device body. In some embodiments of the present BHAs, the valve body is configured to be rotated with the device body to selectively permit fluid communication to the one or more of the plurality of ports to actuate the respective deflection actuators.

In some embodiments of the present BHAs, for each revolution of the valve body: a first rotational speed of the valve body causes the first volume of fluid to be directed to the one or more plurality of ports; and a second rotational speed of the valve body causes the second volume of fluid to be directed to the one or more plurality of ports.

In some embodiments of the present BHAs, each of the first rotational speed and the second rotational speed is different from a rotational speed of the device body.

In some embodiments of the present BHAs, the valve body is configured to be rotationally stationary relative to a longitudinal axis of the device body. In some embodiments of the present BHAs, the valve body comprises a gate valve.

Some embodiments of the present steering and communication systems comprise one of the present BHAs, at least one system sensor configured to detect a second downhole parameter comprising: steering data associated with a third value of the second downhole parameter; and communication data associated with a fourth value of the second downhole parameter.

In some embodiments of the present systems, the second downhole parameter is fluid pressure. In some embodiments of the present systems, each of the third value and the fourth value of the second downhole parameter is detected by the at least one system sensor in response to fluid displaced by the actuation of the plurality of deflection actuators.

Some embodiments of the present systems comprise a measurement while drilling (MWD) tool, the MWD tool having a first one of the at least one system sensor. In some embodiments of the present systems, the MWD tool is configured to communicate the steering data and the communication data to surface. Some embodiments of the present systems comprise a logging while drilling (LWD) tool, the LWD tool having a second one of the at least one system sensor. In some embodiments of the present systems, the LWD tool is configured to communicate the steering data and the communication data to surface. Some embodiments of the present systems comprise a drill string.

Some embodiments of a method of pointing a rotary drill bit comprise delivering a first fluid to one of the present steering and communication systems, wherein the first fluid comprises a first characteristic; detecting, via the at least one device sensor, the first characteristic; controlling the plurality of deflection actuators in response to the detection of the first characteristic; delivering a second fluid to the steering and communication system, wherein the second fluid comprises a second characteristic; detecting, via the at least one device sensor, the second characteristic; controlling the plurality of deflection actuators in response to the detection of the second characteristic; detecting, via the at least one system sensor, the second fluid parameter, wherein the second fluid parameter is influenced by: the control of the plurality of deflection actuators in response to the first characteristic; and the control of the plurality of deflection actuators in response to the second characteristic; and transmitting the data associated with the second fluid parameter to surface. In some embodiments of the present methods, the first characteristic is indicative of the first value of the first downhole parameter. In some embodiments of the present methods, the second flowrate is indicative of the second value of the first downhole parameter.

The term "coupled" is defined as connected, although not necessarily directly, and not necessarily mechanically; two items that are "coupled" may be unitary with each other. The terms "a" and "an" are defined as one or more unless this disclosure explicitly requires otherwise. The term "substantially" is defined as largely but not necessarily wholly what is specified (and includes what is specified; e.g., substantially 90 degrees includes 90 degrees and substantially parallel includes parallel), as understood by a person of ordinary skill in the art. In any disclosed embodiment, the terms "substantially," "approximately," and "about" may be substituted with "within [a percentage] of" what is specified, where the percentage includes 0.1, 1, 5, and 10 percent.

The phrase "and/or" means and or or. To illustrate, A, B, and/or C includes: A alone, B alone, C alone, a combination of A and B, a combination of A and C, a combination of B and C, or a combination of A, B, and C. In other words, "and/or" operates as an inclusive or.

The terms "comprise" (and any form of comprise, such as "comprises" and "comprising"), "have" (and any form of have, such as "has" and "having"), "include" (and any form of include, such as "includes" and "including"), and "contain" (and any form of contain, such as "contains" and "containing") are open-ended linking verbs. As a result, an apparatus that "comprises," "has," "includes," or "contains" one or more elements possesses those one or more elements, but is not limited to possessing only those elements. Likewise, a method that "comprises," "has," "includes," or "contains" one or more steps possesses those one or more steps, but is not limited to possessing only those one or more steps.

Any embodiment of any of the apparatuses, systems, and methods can consist of or consist essentially of—rather than comprise/include/contain/have—any of the described steps, elements, and/or features. Thus, in any of the claims, the term "consisting of" or "consisting essentially of" can be substituted for any of the open-ended linking verbs recited above, in order to change the scope of a given claim from what it would otherwise be using the open-ended linking verb.

The feature or features of one embodiment may be applied to other embodiments, even though not described or illustrated, unless expressly prohibited by this disclosure or the nature of the embodiments.

Further, a device or system that is configured in a certain way is configured in at least that way, but it can also be configured in other ways than those specifically described.

Some details associated with the embodiments described above and others are described below.

DETAILED DESCRIPTION OF ILLUSTRATIVE EMBODIMENTS

Figure 1:
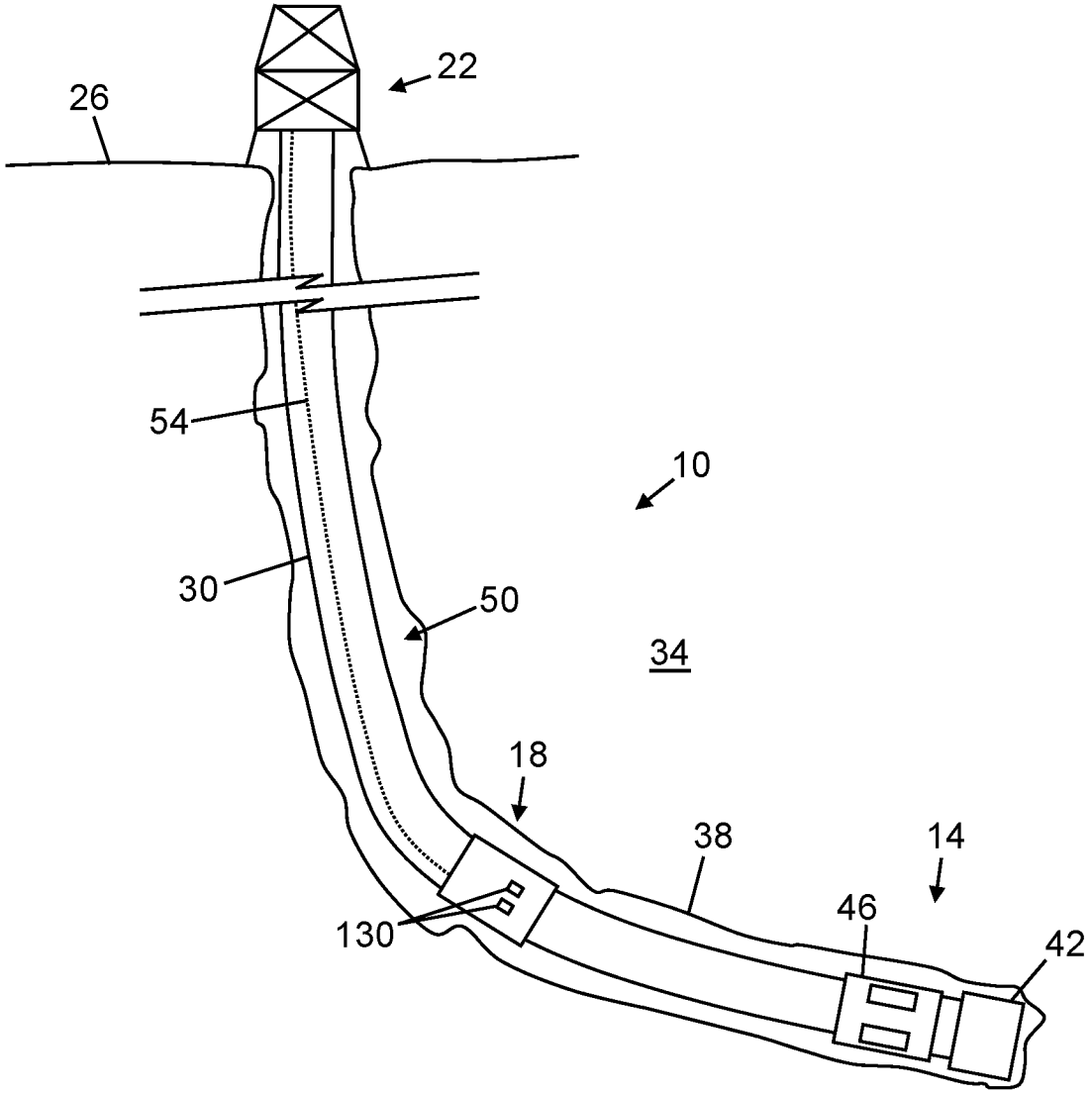
FIG. 1 depicts a schematic view of one embodiment of the present steering and communication systems having a bottom hole assembly (BHA).
Figure 3:
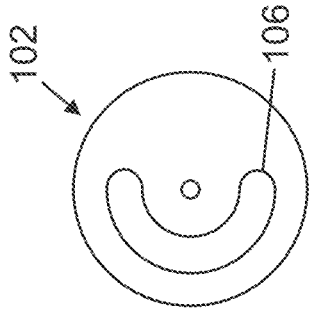
FIG. 3 depicts a top view of a portion of an embodiment of the present valve bodies that is suitable for use with the directional control system of FIG. 2.
Figure 4:
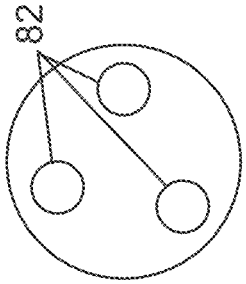
FIG. 4 depicts a top cross-section view of a portion of the directional control system of FIG. 2, taken along line 4-4 of FIG. 2.

Referring now to the figures, and more particularly, to FIG. 1, shown therein and designated by reference numeral 10 is a schematic of an embodiment of the present steering and communication systems. As shown, system 10 can be suspended via a drill string 30 from a rig 22 at a surface 26, and advanced into a subterranean formation 34 to form a wellbore 38. System 10 comprises a bottom hole assembly (BHA) 14 having a data acquisition system 18, a directional control system 46, and rotary drill bit 42. Rotary drill bit 42 is configured to cut into formation 34 to form wellbore 38 and directional control system (e.g., rotary steering system or deflection device) 46 is configured to control a position of the BHA relative to the wellbore as the drill bit advances into the formation.

As system 10 advances into formation 34, fluids can be circulated through the drill string and the drill bit to assist in the drilling process. For example, drilling "mud" can be pumped through drill string 30 and BHA 14 and out through drill bit 42, into an annulus 50 between the drill string and the wellbore, so the fluid can lubricate and cool drill bit 42 and clear cuttings and other undesired elements in wellbore 38 away from the trajectory of the drill bit. The drilling mud is thereafter pushed back to surface 26 via annulus 50.

As system 10 advances into formation 34, a variety of downhole formation and equipment properties may be gathered to confirm proper functioning of the system and to detect changes in formation 34. To that end, system 10 can include data acquisition system or sub (DAS) 18 with one or more tools that are configured to measure one or more downhole properties. DAS 18, or any portion thereof, can communicate via a surface telemetry system in DAS 18 with one or more devices at surface 26 via a communication channel 54 that can be wireless (e.g., via pulses in the drilling mud) or wired (e.g., via specially configured drill pipe). In this embodiment, DAS 18 can comprise a logging while drilling (LWD) system, a measurement while drilling (MWD) system, a surface telemetry system configured to communicate data to surface 26, and/or any other suitable communication or data acquisition systems or components. As such, data communicated to surface 26 by DAS 18 can include inclination and azimuth of portions of the wellbore 38 through which DAS 18 travels, rotational speed of drill string 30, downhole vibrations, downhole temperature, torque and/or weight being exerted on drill bit 42, fluid pressure, fluid flow rate, fluid volume, and/or the like, geological characteristics including density, porosity, resistivity, acoustic-caliper, inclination at the drill bit (NBI), magnetic resonance, formation pressure, and/or the like. As shown in FIG. 1, DAS 18 can be disposed along drill string 30 spaced from (and up-hole of) one or more components of BHA 14, such as up-hole of directional control system 46. In some embodiments, a DAS (e.g., 18) can be coupled directly to any one or more components of a BHA (e.g., 14), such as, for example, coupled directly to a directional control system (e.g., 46).

Establishing reliable and low-cost communication between DAS 18 and directional control system 46 and/or drill bit 42 and may be beneficial to confirm proper functioning of the directional control system and/or the drill bit at surface 26. For example, while DAS 18 may be configured to capture data about the direction of the wellbore, that data is some distance away from the drill bit and, especially thousands of feet below the surface where small variations can have meaningful consequences, it may be more preferable in at least some circumstances to measure and capture the direction closer to the drill bit itself.

To that end, as discussed herein, directional control system 46 can be configured to communicate its operating status to DAS 18 such that the DAS can transmit data indicative of the operating status of the directional control system, and thus BHA 14, to surface 26 using existing data acquisition communication wired or wireless channels 54. As such, direct communication between directional control system 46 and/or drill bit 42 and surface 26 may not be required. Further, as discussed herein, directional control system 46 can be configured to communicate its operating status and/or sensed data to DAS 18 wirelessly such that expensive communication hardware between the directional control system and the DAS may not be required.

Figure 2:
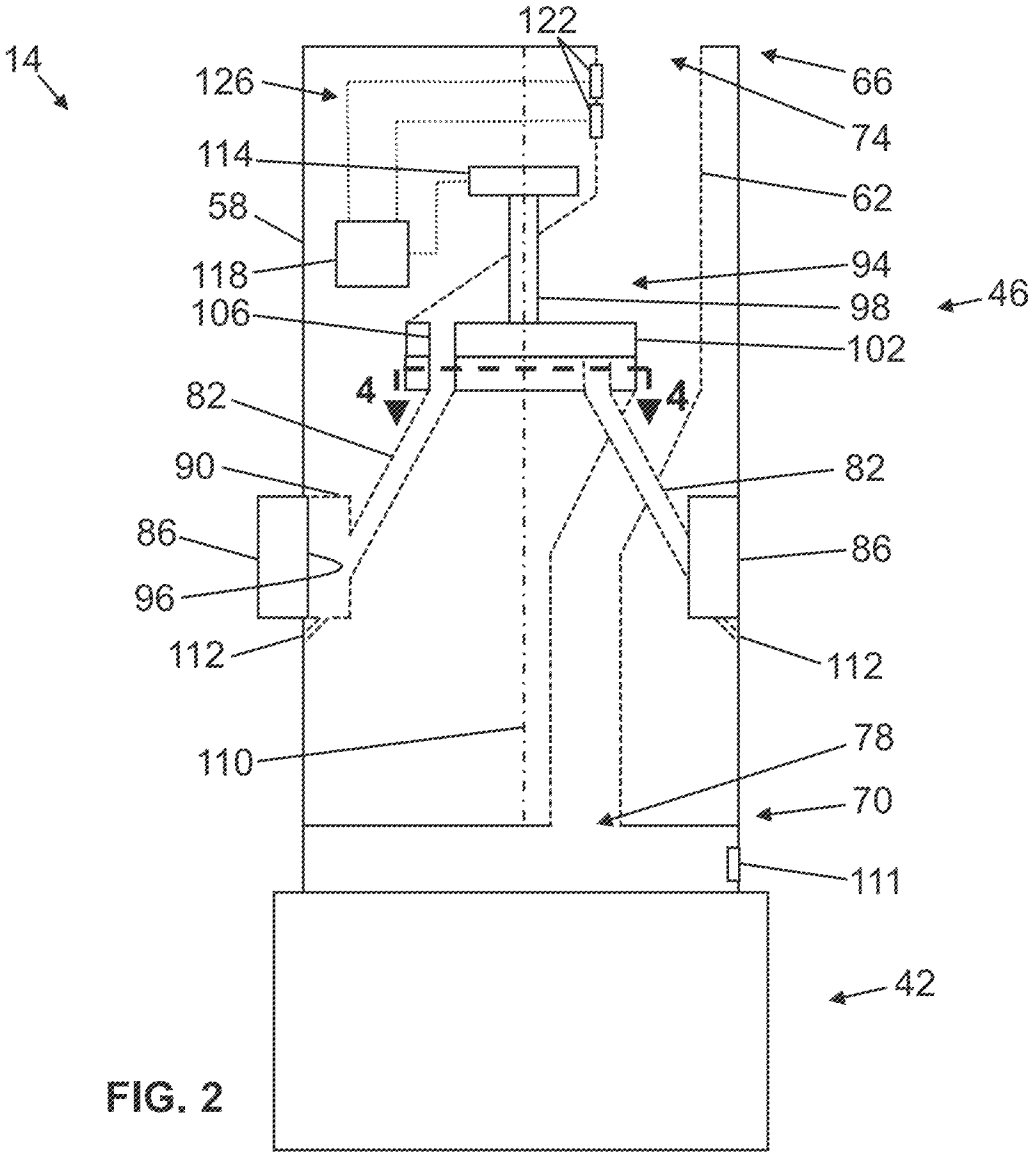
FIG. 2 depicts a schematic view of a directional control system and drill bit, each of which are suitable for use in the BHA of FIG. 1.

Referring additionally to FIG. 2, shown is a portion of an exemplary embodiment of the present BHAs 14, specifically showing the directional control system 46 and drill bit 42. Non-limiting examples of directional control system 46 include Rotary Steerable Downhole Tooling systems, which are commercially available from D-Tech Drilling Tools Inc., of Houston, Texas, USA. For further example, non-limiting examples of directional control system 46 are disclosed in U.S. patent application Ser. No. 09/683,358, the contents of which are hereby incorporated by reference in its entirety.

In the depicted configuration, directional control system 46 depicts a deflection device that includes a device body 58 defining a lumen 62 that extends between a first end 66 and a second end 70 of the body. Lumen 62 comprises an inlet 74 and an outlet 78. As shown, device body 58 is configured to be coupled to drill bit 42 and, as such, rotate with the drill bit during operation.

During operation, drilling fluid may be received through inlet 74 of device body 58 and discharged through outlet 78 to lubricate and cool drill bit 42, and clear cuttings and other undesired elements in wellbore 38 from the trajectory of the drill bit. A portion of drilling fluid flowing from inlet 74 to outlet 78 may be diverted to steer BHA 14 and to communicate with DAS 18. To illustrate, device body 58 defines a plurality of ports 82 to which drilling fluid can be diverted to actuate a plurality of deflection actuators 86 between an extended position and a retracted position. As shown in FIG. 2, each port 82 is in fluid communication with inlet 74 of lumen 62 and provides fluid communication between the inlet and a respective deflection actuator recess 90. Coupled to device body 58 and disposed at least partially within respective recesses 90 are respective deflection actuators 86 that, when exposed to fluid within the recess, tend to move from a retracted position to an extended position in which the deflection actuator extends further laterally outward from device body 58 than when the deflection actuator is in the retracted position.

Each recess 90 and each deflection actuator 86 is circumferentially spaced from another recess (e.g., 90) and deflection actuator (e.g., 86) about device body 58. Directional control system 46 can have any suitable number of deflection actuators 86 and corresponding recesses 90 such as, for example, two, three, four, five, six or more.

Deflection actuators 86 are circumferentially spaced about device body 58 such that each deflection actuator can be selectively actuatable between the extended position and the retracted position to steer BHA 14. For example, during a field operation, BHA 14 can be rotated at some speed, such as, for example, 30, 40, 50, 60, 100, 120 or more rotations per minute (RPM). In order to keep drill bit 42 pointed in a single particular direction, deflection actuators 86 must be extended and retracted to coordinate with the rotational speed of BHA 14. In other words, if BHA 14 is rotating at 60 RPM during a field operation, each deflection actuator is actuated between the extended and retracted position approximately every second.

Directional control system 46 can comprise a valve body 94 configured to selectively actuate each deflection actuator 86 between the extended and retracted positions as BHA 14 rotates. That is, valve body 94 is configured to move to selectively and successively permit fluid communication between inlet 74 of device body 58 and one or more respective ports 82. In this embodiment, valve body 94 comprises a rotary valve body comprising a shaft 98 coupled to a disc 102 having an aperture 106. Shaft 98 can be rotated to cause disc 102 to block and unblock fluid communication to ports 82 by aligning and misaligning aperture 106 with respective ports 82. By selectively permitting fluid communication to ports 82 in succession, fluid diverted from lumen 62 flows to a corresponding deflection actuator recess 90 associated with the port and the fluid acts on a piston surface 96 of deflection actuator 86 to move the deflection actuator from the recessed position to the extended position. Directional control system 46 can be configured to passively allow one or more deflection actuator(s) 86 to move from the extended position to the retracted position. For example, valve body 94 can be moved such that fluid communication between inlet 74 and a respective port 82 is blocked and as deflection actuator 86 contacts formation 34, the deflection actuator can be urged by the formation back into its deflection actuator recess 90 and, in so doing, expel fluid within the recess and/or the port through a discharge port 112. In some embodiments, a directional control system (e.g., 46) can have a plurality of valve bodies (e.g., 94), such as, for example, one or more gate valves, solenoid valves, and/or the like, that selectively block and unblock respective ports (e.g., 82) to control fluid flow therethrough.

Valve body 94 can move at any suitable rotational speed relative to ports 82 to effectuate the fluid communication to ports 82 described herein such that directional control system 46 steers BHA 14 and communicates with DAS 18. For example, valve body 94 can be actuated such that the valve body rotates at a first rotational speed that is different from a second rotational speed of device body 58 during drilling. To that end, each of valve body 94 and device body 58 can be configured to rotate about a longitudinal axis 110 of device body 58, albeit at different rotational speeds, to selectively permit fluid communication to ports 82 to actuate respective deflection actuators 86. In some embodiments, a valve body (e.g., 94) can be configured to be rotationally stationary relative to a longitudinal axis (e.g., 110) of a device body (e.g., 58) while the device body rotates relative to the longitudinal axis.

Movement of valve body 94 can be controlled by a power source 114, such as a motor, to selectively permit fluid communication between inlet 74 and ports 82. Power source 114 can be controlled by a digital controller 118, such as a programmable logic controller (PLC) or any other suitable controller, such that the controller actuates valve body 94 to adjust fluid communication to ports 82. Controller 118 can be configured to actuate valve body 94 based on one or more downhole parameters detected by one or more sensors 122. For example, controller 118 can be configured to receive data from sensor(s) 122 (e.g., via a wired or wireless communication 126), and, based on the data detected by the sensors, actuate valve body 94 in accordance with the data detected by the sensor(s). As such, by controlling the sensed downhole parameter from surface 26, an operator at the surface can cause controller 118 to control the frequency and time duration that each successive port 82 is in fluid communication with inlet 74, thereby affecting the frequency and time duration of the actuation of each deflection actuator 86 and, as a result, the direction of the drill bit.

Suitable downhole parameters or characteristics used to effectuate the actuation of deflection actuators 86 as described herein can comprise fluid pressure, fluid flow rate, fluid volume, acoustics and/or the like and sensor(s) 122 can comprise any suitable sensor(s) capable of detecting data indicative of one or more of such downhole parameters.

Controller 118 can be configured to control the steering of BHA 14 based on steering instructions (which may be received, e.g., in the form of drilling fluid having a particular pressure signature with a particular amplitude, frequency, and/or recognizable pattern) transmitted to directional control system 46. Steering instructions can be transmitted via drilling mud from surface 26 (through drill string 30), a signal relayed by DAS 18, and/or electrical communication from the surface. In one embodiment, steering instructions can be associated with a downhole parameter of the pumped fluid. For example, to steer the BHA 14, fluid can be pumped through drill string 30 and enter inlet 74 of device body 58. Next, sensor(s) 122 can detect one or more first downhole parameters of the pumped fluid, which can be associated with the steering instructions. In this example, the steering instructions can be associated with a first value of fluid pressure.

Controller 118 can then receive data from sensor(s) 122 indicative of the steering instructions. In turn, controller 118 actuates power source 114 such that the power source rotates valve body 94 relative to device body 58 (e.g., and thus relative to ports 82) at a suitable first rotational speed, such as, for example, at 60 RPM, which the controller has been programmed to associate with the initial steering instructions, and in this particular instance, the first value of fluid pressure. For each revolution of valve body 94 relative to device body 58 at the first rotational speed, the valve body causes a first volume of fluid to be directed to each port 82 to actuate a respective deflection actuator 86. As such, deflection actuators 86 steer BHA 14 in a particular direction associated with the initial steering instructions. In this way and others, deflection actuators 86 are actuated between the extended and retracted positions in response to the steering instructions.

The actuation of deflection actuators 86 displaces fluid within annulus 50 between system 10 and formation 34. The displacing of fluid by actuators 86 can cause a change in the fluid characteristics (e.g., measured by amplitude and/or frequency of an electric signal) of the fluid uphole from directional control system 46 (e.g., at DAS 18), such as a pressure pulse, similar to a ripple effect. The change in fluid characteristics caused by the displacement of fluid by deflection actuators 86 is referred to herein as an outgoing signal. The outgoing signal can be detected by sensor(s) 130 of DAS 18. For example, the steering instructions can cause directional control system 46 to act in accordance with a particular steering scheme associated with the steering instructions, and such a steering scheme can create an "outgoing steering signal" (e.g., in the form of drilling fluid having a particular pressure signature with a particular amplitude, frequency, and/or recognizable pattern), which is created by the fluid displaced by the actuation of deflection actuators 86.

Directional control system 46 can be configured to transmit additional outgoing signals in addition to, or in place of, the outgoing steering signal in order to communicate information to DAS 18. Some configurations of outgoing signals are combined (i.e., compound) signals in the sense that they are representative of more than one underlying piece of information. For example, such a compound signal emitted from directional control system 46 may include an outgoing steering signal and an outgoing communication signal. The outgoing steering signal component is representative of an action taken to steer (i.e., change or maintain direction of) BHA 14, for example, a pulse delivered to a port 82 to actuate a corresponding deflection actuator 86. The outgoing communication signal component is representative of an additional piece of information over and above the outgoing steering signal component, for example, information about the direction of the drill bit.

To illustrate, directional control system 46 can actuate deflection actuators 86 in such a way that the deflection actuators displace fluid according to a scheme or pattern (associated with an "outgoing communication signal") that recognizably deviates (e.g., to an operator and/or to a computer processor) from the outgoing steering signal alone, resulting in a combined signal that includes both the steering signal component and the communications signal component. In this way and others, directional control system 46 can "encode" an outgoing signal with additional information. The combined signal is sufficiently different from the steering signal component alone that an operator and/or a computer processor is able to discern or "decode" the communication signal component from the steering signal component, but not so different that directional control system 46 substantially alters the steering of BHA 14 relative to the direction or path provided by the steering instructions.

In some configurations, such as a rotating directional control system 46 that periodically delivers pulses to respective ports 82 and deflection actuators 86, the outgoing steering signal component may be repetitive or follow a predetermined pattern (e.g., period pressure pulses), such that it is relatively straightforward for a person or computer to discern an outgoing communication signal component by identifying the portion of a compound signal that deviates from an expected pattern.

The communication signal component can be added to the steering signal component by any of various ways. For example, a "hiccup" can be caused in the actuation of valve body 94, where one or more corresponding deflection actuator(s) 86 each displace a pulse of fluid and creates a corresponding pressure pulse that differs from the steering signal component. The magnitude and/or duration of each such pressure pulse can be measured and one or more such pressure pulses correlated by a receiver to the data encoded in the communication signal component.

In one embodiment, directional control system 46 can be configured to transmit outgoing communication signals that convey one or more downhole characteristics, such as, for example, the direction (e.g., inclination and azimuth) of BHA 14, and/or pressure and/or temperature detected at the BHA). Such transmissions can occur at defined intervals, or in response to a detected condition. For example, directional control system 46 can be configured to actuate deflection actuators 86 to transmit an outgoing communication signal when BHA 14 reaches and/or passes a predetermined inclination and/or azimuth threshold, or when a detected condition (e.g., temperature) exceeds a threshold.

The present communication methods can be useful for transmitting data (e.g., data related to downhole BHA characteristics or conditions measured by one or more sensors on BHA 14) from directional control system 46 to DAS 18 in instances where such data may not otherwise have a means for transmission between the directional control system and the DAS (e.g., from the directional control system to the DAS), such as where the directional control system and/or the DAS are not hardwired for such communication. Further, the present communication methods can be useful for transmitting data from surface 26 to DAS 18 (e.g., by relaying a command from the surface to the DAS via directional control system 46 as described below).

For example, detected data by directional control system 46, such as inclination, azimuth, temperature, pressure, and/or the like can be communicated to DAS 18. For example, directional control system 46 can be equipped with one or more sensors 111 configured to detect data indicative of azimuth, temperature, pressure, and/or the like of the directional control system. Controller 118 can be configured to receive data from sensor(s) 111 and, based on the data detected, actuate deflection actuators 86 such that the communication signal component conveys the data detected by the sensors.

For further example, directional control system 46 can be used to relay a command from surface 26 to DAS 18. For example, fluid can be pumped from surface 26 through drill string 30 to directional control system 46. Typically, commands embedded in the pumped fluid (e.g., pulse variations) in drill string 30 are unable to be detected by sensors 130 of DAS 18, one or more of which can be housed internally within the DAS and/or housed externally on the DAS (i.e., in annulus 50). However, using the present communication methods, directional control system 46 can be configured to receive the commands embedded in the pumped fluid and then convey that command to DAS 18 via the outgoing communication signal component described herein. For example, pressure pulses in the pumped fluid in drill string 30 may be detected by sensor 122, which ultimately causes controller 118 to actuate deflection actuators 86 to transmit an outgoing communication signal component to DAS 18. Thereafter, sensors 130 of DAS 18 can be configured to detect the communication signal component from directional control system 46 and the DAS can decode the communication signal component using an onboard processor. In at least this way, communication between the surface 26 and DAS 18 (e.g., via directional control system 46 as a relay) can be accomplished without the need for any additional communication hardware.

Because the actuation of valve body 94, in association with the steering instructions for directional control system 46, can be quickly changed back and forth, a change in steering instructions (meant to confirm proper operation of BHA 14) can be configured such that the directional control system embeds a command or message to DAS 18, but does not affect the steering direction of the BHA. For example, at least because the characteristics of fluid supplied to directional control system 46 can be momentarily changed (e.g., changed from the first value of fluid pressure to the second value of fluid pressure and back to the first value in less than five seconds, such as in less than four, three, two, or one seconds), as opposed to longer durations of change (e.g., more than five seconds in duration) typically associated with the change of steering direction, controller 118 is able to actuate valve body 94 to simultaneously steer BHA 14 and also emit the output signals with minimal effect on the steering direction of the BHA. Directional control system 46 can thus "encode" an outgoing signal based on a momentary change in steering instructions (e.g., by creating a pressure pulse in the fluid in annulus 50). In some embodiments, to eliminate any effect on the steering of BHA 14, outgoing signals from directional control system 46 can be transmitted while the BHA is rotating off bottom (i.e., while the BHA rotates without any axial movement through wellbore 38).

In the disclosed configurations, the outgoing signal effectuated by directional control system 46 can be detected by one or more sensor(s) 130 of DAS 18. The outgoing signal (whether it be an outgoing steering signal, an outgoing communication signal, or a compound signal as described herein) can be subtle and/or have subtle changes. Although the outgoing signal, and its subtle changes, may not detectable at surface 26, the outgoing signal can be detected by DAS 18 via sensor(s) 130. After detecting the outgoing signal, all or part of the outgoing signal can be transmitted via DAS 18 and existing data acquisition communication wired or wireless channels 54 to surface 26 to be decoded. In some embodiments, DAS 18 can be configured to decode all or part of the outgoing signal before transmitting data to surface 26. For example, DAS 18 can comprise a processor having software configured to compare all or part of the outgoing signal to an expected signal and/or pattern and cause the DAS to transmit all or part of the compared signal data to surface 26 via communication channels 54. Such data can be communicated from DAS 18 continuously, periodically (e.g., at predetermined intervals of time), and/or intermittently (e.g., at irregular intervals of time).

By decoding the signals from directional control system 46 and comparing the signal data to an expected signal and/or pattern, it is possible to distinguish between output signals indicative of the operation of BHA 14 and random changes in fluid pressure frequencies and amplitude that occur naturally as the BHA advances into formation 34. Further, by confirming that the decoded outgoing signal matches (e.g., within a 15, 10, or 5 percent of) the expected amplitude or frequency it is possible to confirm proper functioning of directional control system 46 and/or drill bit 42.

Outgoing signals (e.g., pressure pulses) from directional control system 46 are effectuated by the existing hardware components equipped on the directional control system. Similarly, the outgoing signals (e.g., pressure pulses) from directional control system 46 can be detectable by the existing sensors 130 equipped on DAS 18 such that the existing hardware on the DAS can be adapted (e.g., via software update) to effectuate the disclosed communication methods disclosed herein. That is, neither DAS 18 nor directional control system 46 may need to be equipped with additional hardware components to effectuate the communication methods disclosed herein.

Additionally, in certain instances, as discussed herein, it can be beneficial to confirm that BHA 14 is indeed performing in accordance with a particular set of steering instructions. To that end, and in accordance with the disclosed configurations, controller 118 can be configured to confirm proper operation of BHA 14 by comparing a steering signal emitted by directional control system 46 (via pressure pulses generated by actuators 86) to an expected steering signal corresponding to desired steering performance (e.g., corresponding to the steering instructions), and controlling and/or varying components of the directional control system (e.g., via new or revised steering instructions) in response to the detected steering signal differing from an expected steering signal.

For example, the steering instructions received by directional control system 46 may change at times (e.g., at regular or irregular intervals), thereby causing the directional control system to actuate deflection actuators 86 differently, and in turn, cause a change in the characteristics of the fluid displaced (and resulting pressure pulses generated) by the updated actuation of the deflection actuators. In this embodiment, changes in the steering instructions can be associated with changes in one or more characteristics of the fluid. For example, the updated steering instructions can be associated with a second value of fluid pressure that is a predetermined value greater than or less than (e.g., at least 10 percent different than the first value) the first value of fluid pressure associated with the initial steering instructions. Sensor(s) 122 can detect the change between the initial and updated steering instructions. Controller 118 can then receive data from sensor(s) 122 indicative of the updated steering instructions. In turn, controller 118 can actuate power source 114 such that the power source rotates valve body 94 relative to device body 58 (e.g., and thus relative to ports 82) at a suitable second rotational speed (e.g., at least 20 percent different than the first rotational speed), such as, for example, at 80 RPM, which the controller has been programmed to associate with the updated steering instructions, and in this particular instance, the second value of fluid pressure. Thus, for each revolution of valve body 94 relative to device body 58 at the second rotational speed, the valve body causes a second volume of fluid to be directed to each port 82 to actuate a respective deflection actuator 86. Similar to the actuation of deflection actuators 86 in response to the initial steering instructions, the actuation of deflection actuators 86 in response to the updated steering instructions also displaces fluid and causes a pulse-like ripple effect in the fluid within annulus 50.

The steering instructions used for confirming proper operation of BHA 14 may be transmitted for a time duration that is different (e.g., shorter) than the initial steering instructions used for actually steering the BHA. For example, the initial steering instructions associated with steering BHA 14 may be transmitted to controller 118 for a predetermined time (e.g., 1, 2, 3, 4, 5, 10, 15, 20 or more minutes). After the predetermined time has elapsed, the steering instructions meant to confirm proper operation of BHA 14 are transmitted to controller 118. These new steering instructions, however, are sent for only a short time duration, such as, for example, less than one minute, 30, 20, 10, 5, or 1 second(s). Thereafter, the initial steering instructions associated with steering the BHA 14 can be sent to the BHA again and the process of sending the two different steering instructions can be repeated to define any suitable recognizable pattern. In at least this way, fluid parameters associated with the steering instructions can be changed relatively quickly, and such a change can cause a "hiccup" in the actuation of valve body 94 of direction control system 46.

In certain instances, it can be beneficial to perform tests or diagnostics on one or more components of BHA 14 before the BHA is deployed to the bottom of a wellbore (e.g., 38). For example, a shallow hole test can be conducted to evaluate proper operation of directional control system 46. To conduct such a test, BHA 14 can be lowered below a rotary table of a rig (e.g., 22) and mud can be pumped into annulus 50 through the BHA as described herein. Proper operation of directional control system 46 (and thus, BHA 14) can be verified by sensing and decoding outgoing signals emitted by directional control system 46 (e.g., via one or more sensor(s) 130 of DAS 18, one or more sensors in the rig piping or mud pumps, and/or the like) as described herein. Such outgoing signals emitted by and used to verify proper operation of directional control system 46 may be non-compound signals (i.e., individual outgoing steering signals or outgoing communication signals) and/or compound signals (e.g., combined outgoing communication signals and outgoing steering signals). In this way and others, settings of BHA 14, and directional control system 46 in particular, can be evaluated, verified, and further calibrated.

that BHA 14 is indeed performing in accordance with a particular set of steering instructions. To that end, and in accordance with the disclosed configurations, controller 118 can be configured to confirm proper operation of BHA 14 by comparing a steering signal emitted by directional control system 46 (via pressure pulses generated by actuators 86) to an expected steering signal corresponding to desired steering performance (e.g., corresponding to the steering instructions), and controlling and/or varying components of the directional control system (e.g., via new or revised steering instructions) in response to the detected steering signal differing from an expected steering signal.

Figure 5:
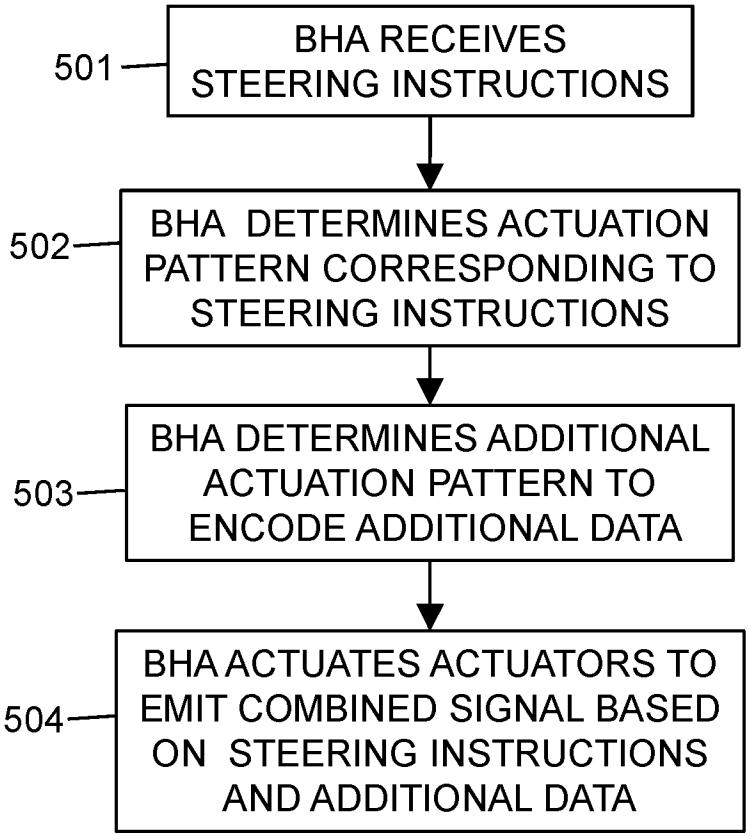
FIG. 5 depicts a flowchart of a first methodology suitable for use with the system of FIG. 1.
Figure 6:
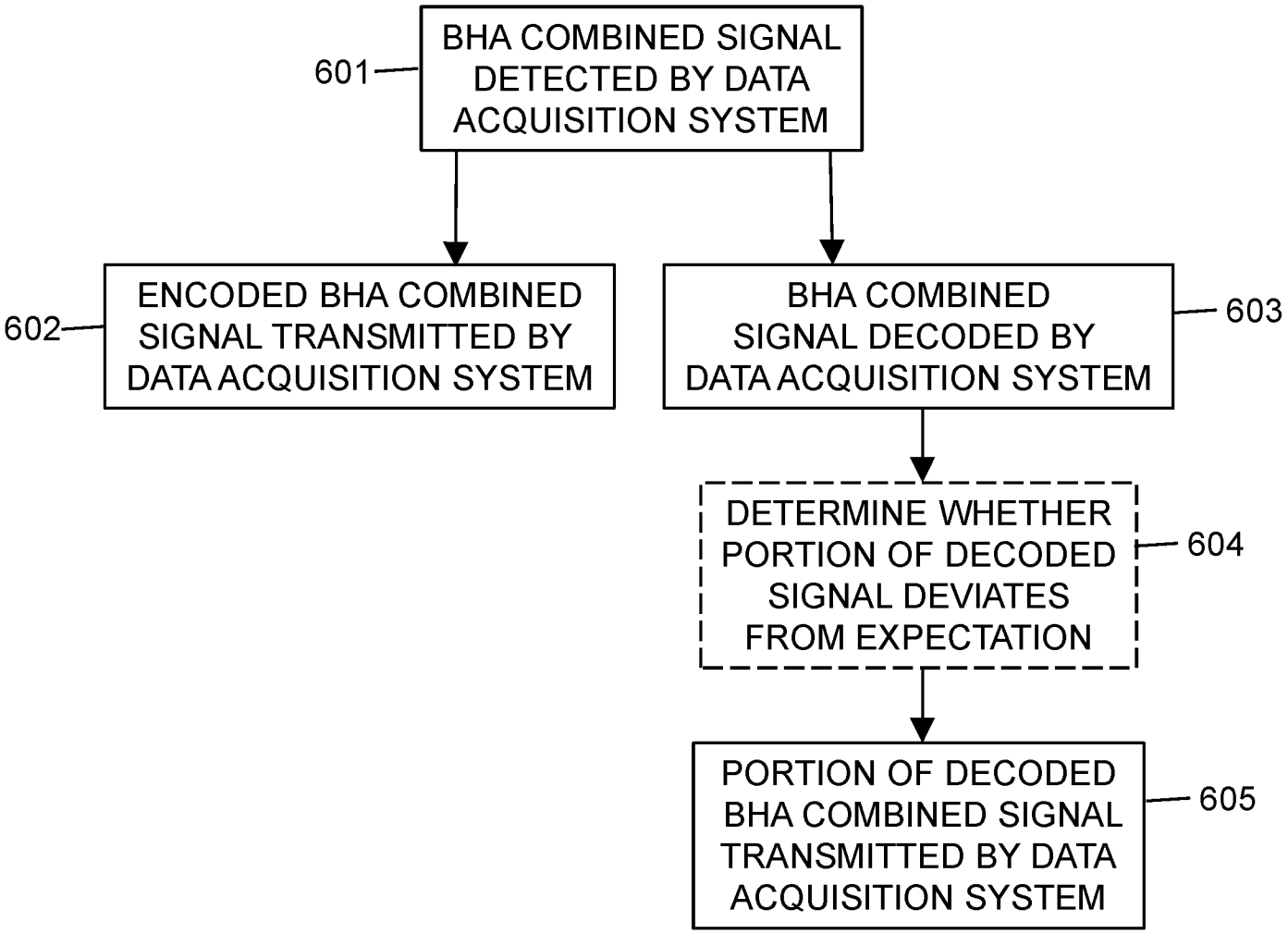
FIG. 6 depicts a flowchart of a second methodology suitable for use with the system of FIG. 1.

Referring additionally to FIGS. 5 and 6, provided is an illustrative example of the methodology that directional control system 46 and DAS 18 respectively employ to steer BHA 14 and communicate additional data within a signal emitted by actuators 86 of the directional control system. First, at step 501 steering instructions (e.g., from surface 26 or DAS 18) and/or a signal from DAS 18 can be received by directional control system 46 (e.g., via detection by sensor(s) 122 of the directional control system). At step 502, directional control system 46 determines an actuation pattern of deflection actuators 86 corresponding to the steering instructions. Then, at step 503, directional control system 46 determines an additional actuation pattern of deflection actuators 86 to encode additional data. At step 504, directional control system 46 actuates deflection actuators 86 to emit a compound signal based on the steering instructions and additional data (if any). The steps shown in FIG. 5 can be repeated any suitable number of times in order to steer BHA 14 and/or transmit additional data.

With respect to DAS 18, at step 601 of FIG. 6, the DAS detects the combined signal emitted by directional control system 46. Then, in one instance, at step 602, DAS 18 can transmit all or part of the still-encoded combined signal to surface 26 for further processing. In another instance, at step 603, DAS 18 can decode all or part of the combined signal and, at optional step 604, the DAS can optionally determine whether all or part of the decoded combined signal deviates from an expected signal pattern. Finally at step 605, DAS 18 can transmit all or part of the decoded combined signal to surface 26, for example, the DAS can transmit a part of the decoded signal that deviates from an expected signal pattern.

In this embodiment, a first one or more of sensor(s) 130 can be included in a LWD tool of DAS 18. A second one of sensor(s) 130 can be included in a MWD tool of DAS 18. At least one of sensor(s) 130 may be a standalone sensor not included in the MWD or LWD tool of DAS 18. Sensor(s) 122 and 130 can be configured to detect at least a frequency and/or amplitude of the steering instructions and the outgoing steering and/or communication signals. Sensor(s) 122 and 130 can be configured to continuously detect the steering instructions and/or outgoing (steering and/or communication) signals and, in response, directional control system 46 and DAS 18 can be actuated and/or provide data at surface 26 in real time. In some embodiments, one or more sensors (e.g., 122 and/or 130) can be configured to periodically or intermittently detect steering instructions and/or outgoing (steering and/or communication) signals, and, in response, a directional control system (e.g., 46) and/or a DAS (e.g., 18) can be actuated and/or provide data to a surface (e.g., 26) periodically or intermittently.

Some embodiments of the present methods of pointing a rotary drill bit (e.g., 42) include delivering a first fluid to a steering and communication system (e.g., 10), wherein the first fluid is delivered at a first flowrate; detecting, via the at least one device sensor (e.g., 122), the first flowrate; controlling the plurality of deflection actuators (e.g., 86) in response to the detection of the first flowrate; delivering a second fluid to the steering and communication system, wherein the second fluid is delivered at a second flowrate; detecting, via the at least one device sensor, the second flowrate; controlling the plurality of deflection actuators in response to the detection of the second flowrate; detecting, via the at least one system sensor (e.g., 130), the second fluid parameter, wherein the second fluid parameter is influenced by: the control of the plurality of deflection actuators in response to the first predetermined flowrate; and the control of the plurality of deflection actuators in response to the second predetermined flowrate; and transmitting the data associated with the second fluid parameter to surface (e.g., 26). In some embodiments of the present methods, the first flowrate is indicative of the first value of the first downhole parameter. In some embodiments of the present methods, the second flowrate is indicative of the second value of the first downhole parameter.

The above specification and examples provide a complete description of the structure and use of illustrative embodiments. Although certain embodiments have been described above with a certain degree of particularity, or with reference to one or more individual embodiments, those skilled in the art could make numerous alterations to the disclosed embodiments without departing from the scope of this invention. As such, the various illustrative embodiments of the methods and systems are not intended to be limited to the particular forms disclosed. Rather, they include all modifications and alternatives falling within the scope of the claims, and embodiments other than the one shown may include some or all of the features of the depicted embodiment. For example, elements may be omitted or combined as a unitary structure, and/or connections may be substituted. Further, where appropriate, aspects of any of the examples described above may be combined with aspects of any of the other examples described to form further examples having comparable or different properties and/or functions, and addressing the same or different problems. Similarly, it will be understood that the benefits and advantages described above may relate to one embodiment or may relate to several embodiments. For example, embodiments of the present methods and systems may be practiced and/or implemented using different structural configurations, materials, ionically conductive media, monitoring methods, and/or control methods.

The claims are not intended to include, and should not be interpreted to include, means-plus- or step-plus-function limitations, unless such a limitation is explicitly recited in a given claim using the phrase(s) "means for" or "step for," respectively.

The invention claimed is:

1. A bottom hole assembly (BHA) comprising:

a directional control system configured to control a position of the BHA relative to a borehole, the directional control system comprising:

a device body defining an inlet and a plurality of ports;

at least one device sensor configured to detect a first downhole parameter;

a plurality of deflection actuators coupled to the device body and each in fluid communication with a corresponding one of the ports, each of the plurality of deflection actuators configured to be selectively actuated to steer the BHA;

a controller configured to receive data from the at least one device sensor; and a valve body configured to selectively permit fluid communication between the inlet and one or more of the plurality of ports to actuate the respective deflection actuators;

wherein the controller is configured to actuate the valve body to adjust fluid communication to the one or more of the plurality of ports to:

steer the BHA; and communicate data indicative of the detected first downhole parameter;

wherein the valve body is actuated by the controller to:

emit a compound signal having a steering component and a communication component;

steer the BHA in a biased manner by actively actuating the plurality of deflection actuators to direct the BHA in a steering direction and emit the steering component; and emit the communication component without changing the steering direction of the BHA, the communication component being indicative of the detected first downhole parameter.

2. The BHA of claim 1, wherein the controller is configured to:

steer the BHA in response to a first value of the first downhole parameter being detected by the at least one device sensor; and communicate the communication component in response to a second value of the first downhole parameter being detected by the at least one device sensor.

3. The BHA of claim 1, wherein the first downhole parameter is fluid pressure, flow rate, or acoustics.

4. The BHA of claim 1, wherein the first downhole parameter is continuously detected by the at least one device sensor.

5. The BHA of claim 1, wherein the first downhole parameter is detected at predetermined intervals of time.

6. The BHA of claim 1, wherein:

to steer the BHA, the controller is configured to actuate the valve body such that a first volume of fluid is directed to the one or more of the plurality of ports to actuate the respective deflection actuator; and to communicate the communication component, the controller is configured to actuate the valve body such that a second volume of fluid is directed to the one or more plurality of ports to actuate the respective deflection actuator.

7. The BHA of claim 6, wherein;

the first volume of fluid is greater than the second volume of fluid; and the controller is configured to actuate the valve body such that the volume of fluid directed to the one or more of the plurality of ports changes from the first volume to the second volume and back to the first volume in less than five seconds.

8. The BHA of claim 1, comprising a rotary drill bit configured to be coupled to the device body and wherein the device body is configured to be rotated with the rotary drill bit.

9. The BHA of claim 1, wherein each of the plurality of ports are configured to be rotated with the device body.

10. The BHA of claim 1, wherein:

the valve body is configured to be rotated with the device body to selectively permit fluid communication to the one or more of the plurality of ports to actuate the respective deflection actuators; and for each revolution of the valve body:

a first rotational speed of the valve body causes a first volume of fluid to be directed to the one or more plurality of ports; and a second rotational speed of the valve body causes a second volume of fluid to be directed to the one or more plurality of ports; and the second rotational speed is at least 20 percent different than the first rotational speed.

11. The BHA of claim 10, wherein each of the first rotational speed and the second rotational speed is different from a rotational speed of the device body.

12. The BHA of claim 1, wherein the valve body is configured to be rotationally stationary relative to a longitudinal axis of the device body.

13. A steering and communication system comprising:

the bottom hole assembly (BHA) of claim 1;

at least one system sensor configured to detect a second downhole parameter comprising:

steering data associated with a first value of the second downhole parameter; and communication data associated with a fourth second value of the second downhole parameter.

14. The system of claim 13, wherein the second downhole parameter is fluid pressure.

15. The system of claim 13, wherein each of the first value and the second value of the second downhole parameter is detected by the at least one system sensor in response to fluid displaced by the actuation of the plurality of deflection actuators.

16. The system of claim 13, comprising a measurement while drilling (MWD) tool, the MWD tool having a first one of the at least one system sensor and wherein the MWD tool is configured to communicate the steering data and the communication data to surface.

17. The system of claim 13, comprising a logging while drilling (LWD) tool, the LWD tool having a second one of the at least one system sensor and wherein the LWD tool is configured to communicate the steering data and the communication data to surface.

18. A method of pointing a rotary drill bit, the method comprising:

delivering a first fluid to the steering and communication system of claim 13, wherein the first fluid comprises a first characteristic;

detecting, via the at least one device sensor, the first characteristic;

controlling the plurality of deflection actuators in response to the detection of the first characteristic;

delivering a second fluid to the steering and communication system, wherein the second fluid comprises a second characteristic;

detecting, via the at least one device sensor, the second characteristic;

controlling the plurality of deflection actuators in response to the detection of the second characteristic;

detecting, via the at least one system sensor, a second fluid parameter, wherein the second fluid parameter is influenced by:

the control of the plurality of deflection actuators in response to the first characteristic; and the control of the plurality of deflection actuators in response to the second characteristic; and transmitting the data associated with the second fluid parameter to surface.

19. The method of claim 18, wherein the first characteristic is indicative of a first value of the first downhole parameter and wherein the second flowrate characteristic is indicative of a second value of the first downhole parameter.

20. A bottom hole assembly (BHA) comprising:

a directional control system configured to control a position of the BHA relative to a borehole, the directional control system comprising:

a device body defining an inlet and a plurality of ports;

at least one device sensor configured to detect a first downhole parameter;

a plurality of deflection actuators coupled to the device body and each in fluid communication with a corresponding one of the ports, each of the plurality of deflection actuators configured to be selectively actuated to steer the BHA;

a controller configured to receive data from the at least one device sensor; and a valve body configured to be rotated with the device body to selectively permit fluid communication between the inlet and one or more of the plurality of ports to actuate respective deflection actuators;

wherein the controller is configured to actuate the valve body to adjust fluid communication to the one or more of the plurality of ports to:

steer the BHA; and communicate data indicative of the detected first downhole parameter; wherein:

to steer the BHA, the controller is configured to actuate the valve body such that a first volume of fluid is directed to the one or more of the plurality of ports to actuate the respective deflection actuator;

to communicate data indicative of the detected first downhole parameter, the controller is configured to actuate the valve body such that a second volume of fluid is directed to the one or more plurality of ports to actuate the respective deflection actuator;

for each revolution of the valve body:

a first rotational speed of the valve body causes the first volume of fluid to be directed to the one or more plurality of ports; and a second rotational speed of the valve body causes the second volume of fluid to be directed to the one or more plurality of ports each of the first rotational speed and the second rotational speed is different from a rotational speed of the device body.

* * * * *